United States Patent [19]

Watson

[11] 4,141,104

[45] Feb. 27, 1979

[54] OVERCENTER DOOR CONTROL DEVICE

[75] Inventor: Roy O. Watson, Kokomo, Ind.

[73] Assignee: FMC Corporation, San Jose, Calif.

[21] Appl. No.: 881,292

[22] Filed: Feb. 27, 1978

[51] Int. Cl.[2] ..... E05F 1/00

[52] U.S. Cl. ..... 16/65; 16/80

[58] Field of Search ..... 16/49, 61, 70, 65, 71, 16/80, 72, 75, 85, 63, 76, 78

[56] References Cited

U.S. PATENT DOCUMENTS

| | | | |
|---|---|---|---|
| 201,500 | 3/1878 | Cobb | 16/80 |
| 724,152 | 3/1903 | Anderson | 16/80 |
| 1,057,929 | 4/1913 | Burdett | 16/65 |
| 2,220,766 | 11/1940 | Hubbs | 16/80 X |
| 2,506,284 | 5/1950 | Tharp | 16/63 |
| 2,569,806 | 10/1951 | Dunlap | 16/65 |

*Primary Examiner*—Werner H. Schroeder
*Assistant Examiner*—Moshe I. Cohen
*Attorney, Agent, or Firm*—A. J. Moore; J. F. Verhoeven

[57] ABSTRACT

An overcenter door control device is disclosed for resiliently holding a door in a predetermined open position after being moved past dead center in one direction, and resiliently holding the door closed after being moved past dead center in the opposite direction.

10 Claims, 4 Drawing Figures

FIG_1
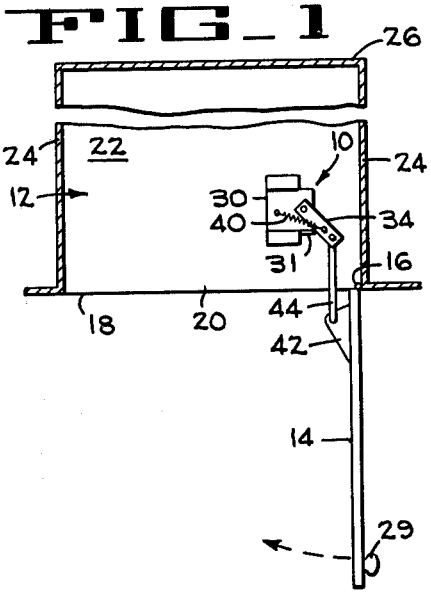
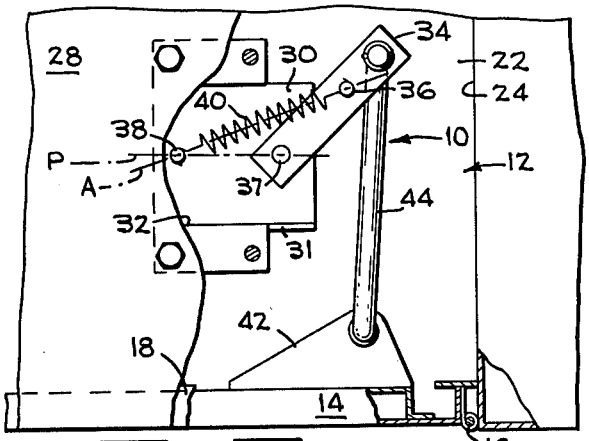
FIG_2
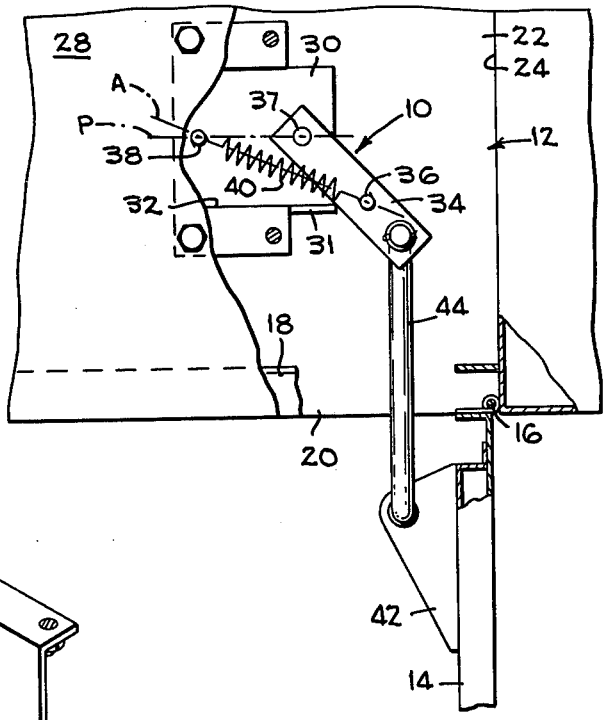
FIG_3
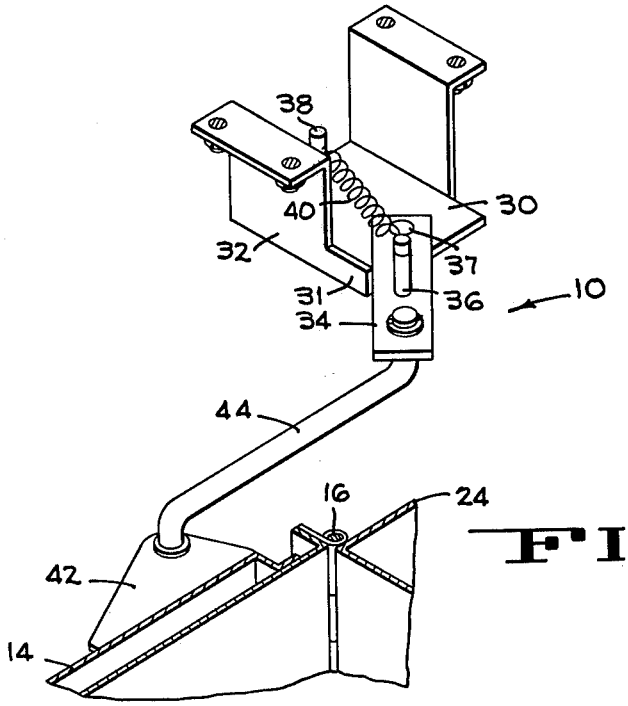
FIG_4

OVERCENTER DOOR CONTROL DEVICE

BACKGROUND OF THE INVENTION

1. Field of the Invention

The present invention relates to a door control device for either resiliently maintaining a door closed or open a predetermined amount depending upon which side of overcenter the door is manually positioned, and more particularly relates to such a door control device for compartments or cabinets such as compartments on a fire truck or the like.

2. Description of the Prior Art

In general, it is important that the doors on fire truck compartments or the like be easily and quickly opened and closed with one hand, and remain in the selected position until manually shifted to the other position. When fighting a fire, the fire truck may from time to time be driven from one location to another and it is desirable that an open compartment door be closed by a fireman before movement of the vehicle to prevent articles from falling out of the compartment. This door closing should be achieved rapidly and preferably by merely slapping the door past dead center. The door control device should also take up as little space as possible in the compartment especially in the area of the compartment opening. Known control devices used with fire truck components are objectionable because they either require two hand operation and/or are large and bulky and include many costly pieces.

The following patents disclose door control devices for doors of different types.

The U.S. Pat. No. 2,220,766 to Hubbs is pertinent in that it operates on the overcenter princple and has an open door position at 90°. The patent discloses a door control device that includes a bell crank arm pivoted to the underside of a bracket secured within and to the roof of a compartment. The free end of the long crank arm is pivoted to a link that is pivotally attached to a door bracket. A tension spring is connected between the short arm of the bell crank and the door frame bracket. When the door is at its 90° open position, the spring is disposed on one side of the pivot pin and urges the bell crank arm against an abutment on the link, maintaining the door open at 90°. When pivoted 90° to the closed position, the spring is on the other side of the pivot pin thereby resiliently holding the door shut. However, a stop flange is not provided on the mounting bracket that is engaged by an overcenter pivot arm when the door is moved to its open position. Also, the overcenter plane is not substantially parallel to the compartment opening as in the present invention but is normal to the opening thus requiring a bell crank rather than a straight pivot arm resulting in a rather large control device which accommodates a considerable amount of frontal area in the compartment.

The U.S. Pat. No. 2,453,831 to Croskey et al. which issued on Nov. 16, 1948 discloses a door check employing the overcenter principle. A transverse rod is secured to the roof of a truck and slidably receives a slide pivotally connected to one end of a link. The other end of the link is pivotally connected to a door bracket by a pin. A spring on the rod is compressed and the pivot pin is overcenter in one direction of an axis through the door hinge and the pin, thereby holding the door closed. When the door is opened, the door pivot pin is overcenter of the axis in the other direction and the spring holds the door open, past the 90° open position and not at a predetermined position, since the door may be swung further open against the urging of the spring. The door check also accommodates considerable frontal area in the compartment.

The U.S. Pat. No. 2,569,806 to Dunlap which issued on Oct. 2, 1951 discloses a double action door holder which employs the overcenter principle and resiliently holds the door at a 90° open position when at one end of its swing, and in its closed position at the other end of its swing. A push rod has one end anchored to the door by a screw eye and its other end is free. A single spring surrounds the push rod with one end anchored to the push rod at the screw eye and the other end anchored to the free end of the rod. A second screw eye is fastened to the door sill and slidably receives the rod. The screw eye is interposed between coils of the spring at the midpoint thereof. This patent is pertient to the extent that it discloses an overcenter door control device which holds the door at its 90° position. However, the door can be forced further open by compressing the outer end of the spring, but when released it will return to its 90° position. Because the door is not positively held from movement beyond its normal open position, strong gusts of wind which may be present when fighting fires are more apt to close the door as compared to the subject device since the springs permit the door to swing in both directions past its open position. Thus, gusts of wind which catch the door as it is moving toward the closed position will more easily close the door as compared to the subject device.

Also, it is apparent that the Dunlap door holder is quite large since it extends substantially the full length of the door.

SUMMARY OF THE INVENTION

In accordance with the present invention an overcenter door control device is provided which resiliently maintains the door in a predetermined open position when placed in the open position, and also resiliently maintains the door closed when placed in the closed position.

The device includes a pivot arm having one end pivotally connected to one wall of a compartment adjacent a hinge which connects the door to the compartment. A stationary anchor also connected to the wall defines a central or intermediate plane so that a compression spring connected between the stationary anchor and a movable anchor on the arm will resiliently hold the other end of the pivot arm either on one side or the other side of the plane. A linkage and door bracket pivotally interconnects the door to said other end of said pivot arm so that movement of the pivot arm also pivots the door between its open and closed positions. An abutment is secured to the wall in position to engage and stop the pivot arm in a predetermined position with the longitudinal axis of the spring on one side of the plane to hold the door in a predetermined open position. When the door is moved to its closed position, the door engages the compartment frame to stop the pivot arm after the axis of the spring is disposed on the other side of the plane thereby resiliently holding the door closed.

The central or intermediate plane is preferably positioned substantially parallel to the compartment opening so that the linkage will be maintained substantially parallel to the door when the door is in its open position and also immediately adjacent one wall of the compartment.

An object of the invention is to provide an inexpensive door control device which is smaller in size and which is positioned within a compartment adjacent one wall and the hinge corner so as to minimize interference with articles being moved into or removed from the compartment.

Another object is to provide an overcenter door control device which will resiliently maintain the door in a predetermined open position after first being manually moved to the open position, and will resiliently maintain the door closed after first being moved to that position.

BRIEF DESCRIPTION OF THE DRAWINGS

FIG. 1 is a diagrammatic horizontal section taken below the roof of a compartment illustrating the overcenter door control device of the present invention with the door being resiliently held open, certain parts of the compartment being cut away.

FIG. 2 is an enlarged plan of the hinge corner of a compartment with the door closed and with parts of the upper compartment wall cut away to illustrate the door control device.

FIG. 3 is an enlarged plan similar to FIG. 2 but with the parts positioned to resiliently hold the door in its open position.

FIG. 4 is a perspective of a door control device and fragment of the door and compartment with the door being held in its predetermined open position.

DESCRIPTION OF THE PREFERED EMBODIMENT

The door control device 10 (FIG. 1) of the present invention is associated with a compartment 12 having a door 14 pivoted by a hinge 16 to one edge of a slam strip frame 18 that defines the opening 20 of the compartment. The compartment 12 also includes a bottom wall 22, two side walls 24, a back wall 26 and an upper wall or roof 28 (FIGS. 2 and 3).

Although the door control device 10 has been designed specifically for use with storage compartments of a fire truck, it will be understood that the device may be used with other types of doors. The door control device 10 permits the door to be quickly opened and closed with one hand, with the operator being confident that the door will be resiliently held in its selected open or closed position. A door knob 29 (FIG. 1) that preferably includes a lock, is manually gripped in the usual manner by an operator when opening the door.

The door control device 10 comprises a generally U-shaped bracket 30 (FIGS. 2–4) that is bolted to the roof 28 of the compartment 12 and has an abutment surface 31 integral with one of its upstanding legs 32. A pivot arm 34 having a movable anchor pin 36 projecting upwardly therefrom has one end pivotally connected to the bracket 30 by a pivot pin 37. The axes of the pivot pin 37 and a stationary anchor pin 38 are disposed in a vertical central or intermediate plane P (FIGS. 2 and 3) that is substantially parallel to the slam strip frame 18 which defines the opening of the compartment.

A helical tension spring 40, having a central longitudinal axis A, is resiliently stretched and is connected between the movable anchor pin 36 rigidly secured to the pivot arm and a stationary anchor pin 38 at a distance more than one half the length of the arm from the pivot end of the arm.

A door bracket 42 is secured to the door 14 adjacent the hinge 16. A connector link 44 is formed from a bent rod and is inserted in holes in the pivot arm 34 and in the door bracket 42 to pivotally interconnect the pivot arm 34 and the bracket 42. The connector link 44 is held in place by cotter pins or the like.

When the door 14 is open as illustrated in FIG. 3, it will be noted that the pivot arm 34 is held in firm resilient engagement with the abutment surface 31 thus preventing further opening of the door 14. Since the longitudinal axis A of the spring 40 is disposed on one side (below as indicated in FIG. 3) of the plane P, the overcenter relationship of the longitudinal axis of the spring 40 causes spring tension to firmly hold the door in its predetermined open position. This predetermined open position is preferably 90° to the slam strip frame 18 but may be a different angle depending upon the position of the abutment surface 31.

When the operator moves the door 14 toward the closed position and past dead center, i.e., when the movable anchor pin 36 is past the plane P, the spring 40 will then complete closing of the door. When the door 14 firmly seats against the slam strip frame 18 as illustrated in FIG. 2, the door is resiliently held closed since the axis A of the spring is on the other side of the plane P. When the door is in closed position it will be noted that the pivot arm 34 can move no further in that direction because of its attachment to the door by the link 44.

In operation, the operator merely opens the door 14 by grasping the knob 29 and swinging the door a sufficient amount so that the axis A of the spring 40 moves past the plane P. The spring 40 will then continue the opening pivotal movement, with or without the aid of the operator, until the pivot arm 34 contacts abutment 31 thereby holding the door in its predetermined open position.

The door 14 may be rapidly closed by the operator by merely slapping the door past the overcenter position in the opposite direction. The spring 40 will then complete closing of the door as indicated in FIG. 2.

From the foregoing description it is apparent that the overcenter door control device of the present invention is simple and inexpensive in design, and is oriented to require a minimum of space in the compartment. The device resiliently maintains the door in a predetermined open position when placed there by an operator, and maintains the door in a closed position when placed there by the operator. The door control device is also easily and rapidly operated by one hand.

Although the best mode contemplated for carrying out the present invention has been herein shown and described, it will be apparent that modification and variation may be made without departing from what is regarded to be the subject matter of the invention.

What I claim is:

1. An overcenter door control device for a door hinged to a frame defining an opening in a compartment or the like having walls extending inwardly from said opening, said device comprising: means defining a pivot arm, means pivotally connecting one end of said arm to one of said walls adjacent said hinge, said pivot arm pivoting about an axis lying in a plane, said plane being intermediate the range of arcuate travel of the other end of said pivot arm, a stationary anchor means connected to said one wall, said pivotal connecting means and said stationary anchor means lying in said plane, a movable anchor means connected to said pivot arm, a tension spring connected between both of said anchor means and having a longitudinal axis, a door bracket secured to said door adjacent said hinge, linkage means pivotally connecting said door bracket to said pivot arm adjacent said other end, and abutment means secured to said one wall in position to engage and stop said pivot arm in a predetermined position with the longitudinal axis of said spring on one side of said plane for resiliently holding the door in a predetermined open position, said door when moved to its closed position abutting said frame to stop said pivot arm with the axis of said spring disposed on the other side of said plane for resiliently holding the door closed.

2. An apparatus according to claim 1 wherein said plane is substantially parallel to said compartment opening and said linkage means is substantially parallel to said door when in the open position.

3. An apparatus according to claims 1 or 2 wherein said one wall is the top wall of the compartment and the axis of said hinge is substantially vertical.

4. An apparatus according to claims 1 or 2 wherein a generally U-shaped bracket is rigidly secured to said one wall; and wherein said pivot means, said stationary anchor means, and said abutment means are connected to said U-shaped bracket.

5. An apparatus according to claims 1 or 2 wherein said pivot arm is a linear arm and said spring is attached to said movable anchor means at a point that is more than one-half the length of the arm from the pivot end thereof.

6. An apparatus according to claim 5 wherein said one wall is the top wall of the compartment and the axis of said hinge is substantially vertical.

7. An apparatus according to claims 1 or 2 wherein said abutment means maintains the door at an angle of about 90° to said opening when the door is open.

8. An overcenter door control device for a door hinged to a frame defining an opening in a compartment or the like having an upper wall, said device comprising: an abutment bracket secured to said upper wall at a point adjacent said hinge, a pivot arm, means pivoting one end of said arm to said bracket, said pivot arm pivoting about an axis lying in a plane, said plane being intermediate the range of arcuate travel of the other end of said pivot arm, stationary anchor means secured to said bracket, said pivot means and said anchor means lying in said plane substantially parallel to said opening, movable anchor means secured to said pivot arm, a tension spring connected between said stationary and movable anchor means and having a longitudinal axis, a door bracket secured to said door adjacent said hinge, linkage means pivotally interconnecting said pivot arm to said door bracket adjacent the other end of said arm, abutment means formed integrally with said abutment bracket in position to engage and stop said pivot arm in a predetermined position with a longitudinal axis of said spring on one side of said plane for resiliently holding the door in a predetermined open position, said door when moved to its closed position abutting said frame to stop said pivot arm with the axis of said spring disposed on the other side of said plane for resiliently holding the door closed.

9. An apparatus according to claim 8 wherein said plane is substantially parallel to said compartment opening and said linkage means is substantially parallel to said door when the door is in the open position.

10. An apparatus according to claim 8 wherein said abutment bracket is U-shaped and includes upstanding legs and wherein one leg forms said abutment means.

* * * * *